United States Patent [19]

Rogo

[11] Patent Number: 4,650,397

[45] Date of Patent: Mar. 17, 1987

[54] SLEEVE SEAL

[75] Inventor: Casimir Rogo, Mt. Clemens, Mich.

[73] Assignee: Teledyne Industries, Inc., Los Angeles, Calif.

[21] Appl. No.: 773,530

[22] Filed: Sep. 9, 1985

Related U.S. Application Data

[63] Continuation of Ser. No. 589,021, Mar. 13, 1984, abandoned.

[51] Int. Cl.[4] ..... F04D 29/08

[52] U.S. Cl. ..... 415/139; 415/115; 415/165; 415/171; 277/26; 277/212 F

[58] Field of Search ..... 415/110, 115, 134–139, 415/159, 165, 167, 45, 171; 277/26, 212 F

[56] References Cited

U.S. PATENT DOCUMENTS

| | | | |
|---|---|---|---|
| 726,032 | 4/1903 | Curtis | 415/171 |
| 3,014,694 | 12/1961 | Pauel et al. | 253/77 |
| 3,199,294 | 8/1965 | Hagen | 415/135 |
| 3,464,705 | 9/1969 | Ryan | 277/26 |
| 3,690,785 | 9/1972 | Lind | 277/26 |
| 4,184,689 | 1/1980 | Brodell et al. | 277/26 |
| 4,251,185 | 2/1981 | Karstensen | 415/136 |
| 4,314,792 | 2/1982 | Chaplin | 415/116 |
| 4,326,835 | 4/1982 | Wertz | 416/241 B |
| 4,403,914 | 9/1983 | Rogo et al. | 415/165 |

FOREIGN PATENT DOCUMENTS

| | | | |
|---|---|---|---|
| 590139 | 7/1947 | United Kingdom | 277/26 |
| 2037380 | 7/1980 | United Kingdom | 415/138 |

*Primary Examiner*—Edward K. Look
*Assistant Examiner*—Joseph M. Pitko
*Attorney, Agent, or Firm*—Gifford, Groh, VanOphem, Sheridan, Sprinkle and Dolgorukov

[57] ABSTRACT

A seal member particularly adapted to seal leakage gaps between turbine vanes in a variable geometry turbine vane assembly comprises a sheet metal strip having a first flange and a second flange angularly disposed with respect to the first flange. The first flange is an anchoring flange comprising separated segments adapted to be secured to a turbine wall on one side of the leakage gap. The other flange is a sealing flange adapted to engage the member on the opposite side of the gap. The spring tension of the metal strip urging the sealing flange against the member can be enlarged or replaced by various means for urging the sealing flange against other member such as a differential pressure across the seal member and the formation of the sealing strip with heat sensitive metals.

13 Claims, 6 Drawing Figures

SLEEVE SEAL

This application is a continuation, of application Ser. No. 589,021, filed Mar. 13, 1984, now abandoned.

BACKGROUND OF THE INVENTION

1. Field of the Present Invention

The present invention relates generally to seal structures to prevent the flow of fluid through gaps between a stationary element and movable element, and more particularly to a fluid seal for use in the high temperature environment of a turbine engine.

2. Description of the Prior Art

Conventional fluid seals, often used to prevent the leakage of gas between parts of a turbine engine, are constructed in a variety of shapes and sizes. For example, "O" rings are a well known form of seal used to close the gap between parts of a turbine engine. Other known forms of seals comprise labyrinth seals, feather seals, carbon rub seals, viscoseals, compression seals, step seals and packed glands. However, many such seals are primarily intended for use between stationary parts for the reason that relative movement between the parts causes wear and destruction of the seal. Worn seals can cause leakage of gas or other fluids, and therefore, would require repeated replacement in order to remain effective.

Moreover, the previously known seals have a fixed geometry and when used in high temperature environments or where the seals are subjected to pressure or temperature changes, they can deform from their initial shape. As a result, they are subject to the disadvantages of high leakage, the exertion of high frictional forces on mating parts which must move relative to one another, or, like labyrinth seals, are very complex and thus costly to produce and replace. Moreover, in high temperature environments, the sealing ability and the working life of these seals can be substantially adversely affected by the high temperature environment. Thus, while it may be useful to utilize highly specialized materials in constructing these seals, the production and composition of these previously known seals substantially increases the cost and complexity of such seals.

SUMMARY OF THE PRESENT INVENTION

The present invention overcomes the above-mentioned disadvantages by providing a seal adapted for use in high temperature environment which flexes to conform to the shape of components with which it is used and whose sealing ability is maintained throughout a wide range of environmental conditions and can be improved by the environmental conditions. In general, the seal comprises a sheet metal strip secured to one of two parts which are spaced to form a gap. The strip includes a flange portion which extends across the gap between the two parts when an adjacent flange of the seal is secured to one of the parts. The invention includes means for resiliently urging the extending portion of the seal against the other part. Preferably, the means utilized, comprises or is enhanced by environmental characteristics within the turbine engine such as pressure differentials across the strip or heat responsive metals in the construction of the seal. Such means can maintain or improve the sealing capacity of the seal within the high temperature environment of a turbine engine.

In addition, the seal is particularly well adapted for use in sealing the components of a variable geometry turbine nozzle wherein one of the parts is displaceable with respect to the other. In the preferred embodiment of the present invention, a sheet metal strip is bent to form an attachment flange and a sealing flange, and the attachment flange is secured to a turbine wall which forms a side wall of a turbine nozzle. A means for adjusting the size of turbine nozzle and adjusting the disposition of turbine vanes within the nozzle permits turbine vanes to be extended into and retracted from the turbine nozzle as desired to obtain desired performance characteristics of the turbine engine. The sealing flange extends against the periphery of the turbine vanes to prevent leakage between the nozzle side wall and the turbine vanes extending into the nozzle. Thus, the strip is adapted to conform to the shape of the turbine vanes and close the gap between the openings in the turbine walls through which the turbine vanes extend. The means which permits the seal to conform to the shape of the turbine vanes comprises a plurality of recesses in the attachment flange of the seal strip which permit deformation of the strip to enable it to conform to the shape of the turbine vanes.

In view of the high temperature environment at the turbine nozzle, the nozzle is preferably provided with a means for cooling the turbine vanes. In the preferred embodiment, an impingement liner within the turbine vanes is attached to a supply pin having a hollow body forming a chamber. The chamber communicates exteriorly of the pin through a slot in the pin. A metering piston pin is slidably received in the supply pin to adjust the size of the orifice communicating between the chamber in the supply pin and the exterior supply of coolant. Adjustment of the orifice corresponds to displacement of the vanes and side walls of the turbine nozzle so that the amount of cooling air can be varied according to the heat transfer requirements of the structure.

Nevertheless, it will be understood that the seal members according to the present invention continue to effectively close the gap between movable and stationary parts within the turbine nozzle assembly. While the sealing device is particularly well adapted to close the leakage gap between the specially configured turbine vanes and the nozzle side wall structure, it will be understood that the seals can be used in other applications as well. Since the seals can be made responsive to pressure or temperature conditions, the seal does not lose its effectiveness in the high temperature environment of the turbine engine. Moreover, since the seal is adapted to conform with the surface configuration of parts within the engine, it is substantially more effective than previously known fixed geometry seals. Moreover, the sheet metal construction of the seal provides a long life and resistance to wear, thus substantially reducing the cost of maintenance and repair of the turbine engine.

BRIEF DESCRIPTION OF THE DRAWING

The present invention will be more clearly understood by reference to the following detailed description of a preferred embodiment of the present invention when read in conjunction with the accompanying drawing in which like reference characters refer to like parts throughout the views and in which.

DETAILED DESCRIPTION OF THE PREFERRED EMBODIMENT OF THE PRESENT INVENTION

Figure 1:
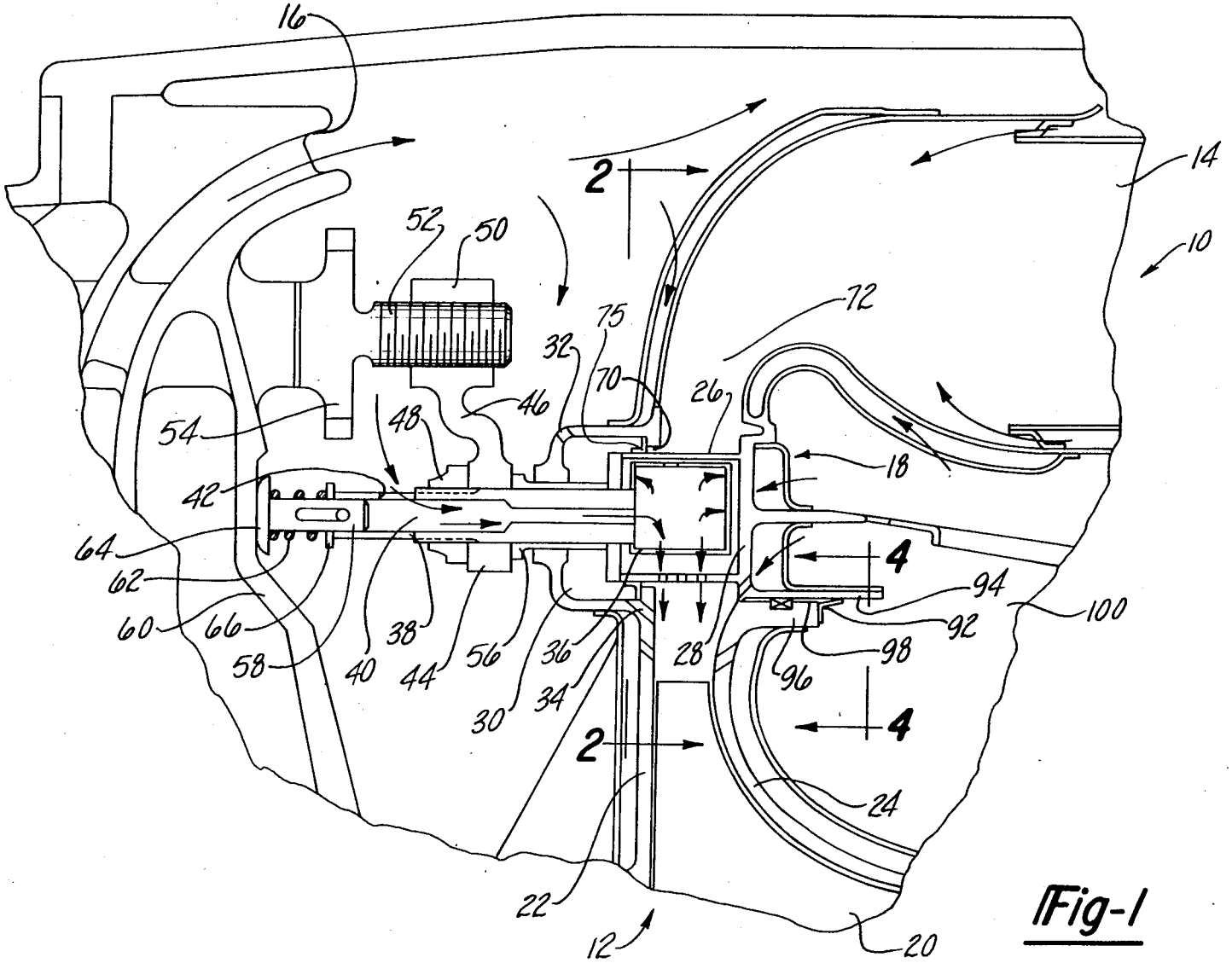
FIG. 1 is fragmentary sectional view of a compressor and variable geometry turbine section of the turbine engine having seals according to the present invention.

Referring first to FIG. 1, turbine engine 10 is thereshown comprising a high-pressure turbine section 12 downstream of a combustor chamber 14. The combustor chamber 14 is in fluid communication with the compressor outlet 16 while a turbine nozzle generally indicated at 18 directs the output from the combustor to turbine rotor 20. The rotor 20 is rotatably mounted between the backface shroud housing 22 and the frontface shroud housing 24. In the nozzle section 18, a plurality of nozzle vanes 26 are secured to the displaceable nozzle side wall assembly 28. The vanes 26 extend into an annular, recessed chamber 30 formed in the backface shroud housing 22.

The chamber 30 is provided with cooling air from the compressor outlet 16 through inlet apertures 32, and the cooling air is then exhausted through exhaust ports 34. In addition, each vane 26 includes an impingement liner 36 which is attached to a supply pin 38. The supply pin 38 includes a hollow body defining chamber 40 communicating with a slot 42 in the pin 38 to direct the flow of cooling air from the compressor outlet 16 to the impingement liner 36.

The supply pin 38 is secured to a sleeve portion 44 of arm 46 by nut 48 for sliding displacement therewith. A second sleeve portion 50 at the other end of the arm 46 is threadably engaged with an elongated stem 52 of the sprocket 54. Appropriate means such as a chain (not shown) actuated by suitable drive means such as an electric or hydraulic motor (not shown) rotates the sprocket 54 to cause axial displacement of the sleeve 50 with respect to the threaded stem 52. As a result, the nozzle sidewall assembly 28, which is secured for displacement with the supply pin 38 by means of the sleeve 56, is displaced as the arm 46 is axially displaced in the turbine engine 10.

A metering piston pin 58 is slidably received into the chamber 40 of supply pin 38 through an open end of the supply pin 38. The metering piston pin 58 is resiliently biased toward the housing wall 60 by a spring 62 interposed between an enlarged head, 64, of the piston pin 58 and a washer 66 at the end of the supply pin 38. Thus, as the supply pin 38 is displaced, the extent to which the piston pin 58 opens or closes the slot 42, varies and meters the amount of cooling air directed through the chamber 40 to the nozzle vanes 26. The supply of cooling air to the vanes 26 is therefore metered in proportion to the variable nozzle sidewall 28 position thereby resulting in more efficient utilization of air for cooling and reducing cooling air injection losses.

In the turbine engine construction as discussed above, a main source of leakage flow occurs through the gap 70 intermediate the edge of the opening in the wall backface shroud housing 22 through which each vane 26 extends and the vane 26. Thus, cooling air from the high pressure chamber 30 flows through the gap 70 to the low pressure mainstream channel 72. In the preferred embodiment of the present invention, the gap 70 is sealed by seals 75 secured to a flange of the backface shroud housing wall 22 so as to maintain a sliding contact with each of the sliding nozzle vanes 26.

Figure 2:
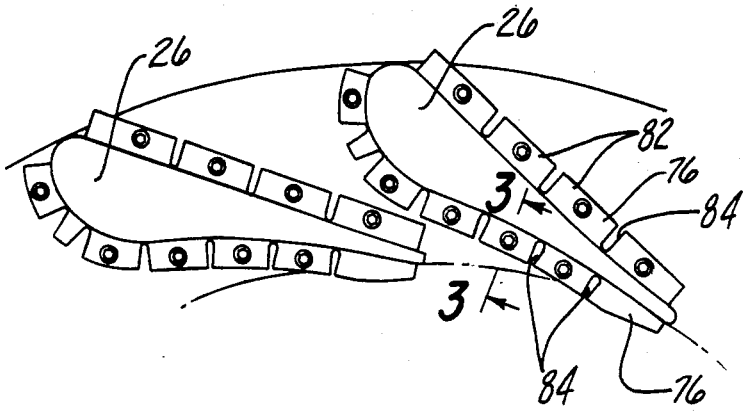
FIG. 2 is an enlarged, fragmentary elevation taken substantially along the line 2—2 in FIG. 1.
Figure 3:
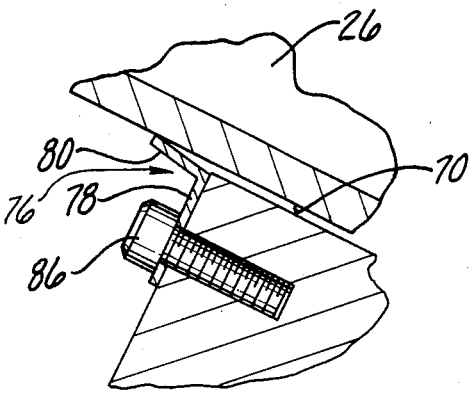
FIG. 3 is an enlarged sectional view taken substantially along the line 3—3 in FIG. 2.

Referring now to FIGS. 2 and 3, each seal 75 comprises sections of an elongated metal strip 76, each section extending circumferentially along substantially one entire side of the periphery of each vane 26. As best shown in FIG. 3, each strip 76 includes an anchor flange 78 and a sealing flange 80. The angle between flange 78 and flange 80 can be adjusted by bending the strip 76 to vary the amount of pressure exerted by the spring tension in the strip 76 that urges flange 80 against the vane 26. As best shown in FIG. 2, the anchor flange 78 comprises a plurality of segments 82 spaced apart by slits in the form of recesses or slots 84. Most of the segments 82 are fastened by bolts 86, spot welds or the like, while the sealing flange 80 rests against the periphery of the vane 26. The segmented anchor flange 78 permits flange 80 to follow the contour of the variously curved nozzle vanes 26. Moreover, when the slots 84 are wide as shown in FIG. 2, the curvature of the sealing strip is continuously maintained about the periphery of the vane 26 without overlapping of the anchoring segments, thus further serving to prevent leakage between the sealing strip 76 and the housing flange.

Figure 6:
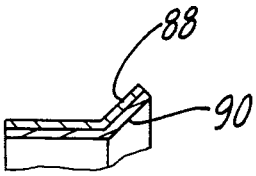
FIG. 6 is a fragmentary partial sectional view illustrating an element of the present invention.

As shown in FIG. 6, the strip 76 can be a bimetallic strip having first metallic layer 88 and a second metallic layer 90, the layers 88 and 90 having different thermal characteristics. For example, if layer 88 is composed of material which expands when subjected to high temperature, to a greater degree than the metal which forms the layer 90, the sealing flange 80 will be urged to tightly engage vane 26 as the engine heats up.

Conversely, when a seal is desired between other parts, if the layer 90 is made of the more heat sensitive material, the flange would be urged away from the abutting structure, which permits leakage of a fluid such as cooling or lubricating fluid through the gap during high temperature operation, but which seals against leakage when the engine is inoperative. Thus, depending upon the gap which is to be sealed and the working environment in which a sealing strip 76 is employed, the sealing characteristics of the strip can be varied as desired.

In the preferred embodiment of the present invention, an additional means for urging the sealing flange 80 against the nozzle vane 26 comprises the pressure differential between the high pressure chamber 30 and the low pressure flow stream channel 72. Thus, the present invention does not require the bimetallic construction discussed above. Moreover, it should be understood that other means for biasing the sealing flange 80 against a gapped member, such as the spring tension of the metal strip 76 itself can also be used in making and using a seal 75 in accordance with the present invention. However, the use of a pressure differential to bias the sealing flange 80 against the periphery of the nozzle vane 26 is advantageous for the reason that it avoids unnecessary frictional stress between the seal and the vanes, and adjusts the sealing force in accordance with the pressure conditions existing within the engine 10.

Figure 4:
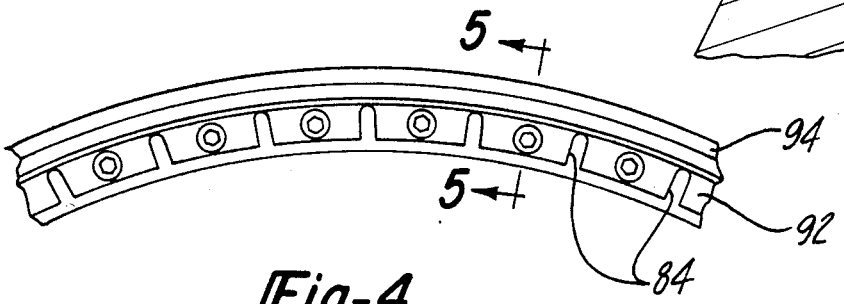
FIG. 4 is an enlarged, fragmentary elevation taken substantially along line 4—4 in FIG. 1.
Figure 5:
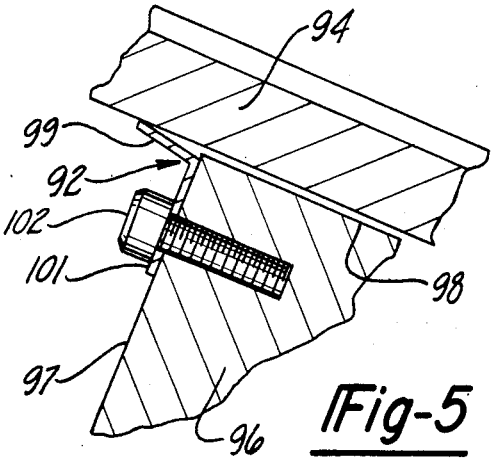
FIG. 5 is an enlarged sectional view taken substantially along line 5—5 in FIG. 4.

Referring again to FIG. 1, a sealing strip 92 seals the gap between the frontface turbine shroud 24 and the nozzle assembly 28. An axially elongated wall portion 94 of the nozzle assembly 28 is spaced apart from an axially extending portion 96 of the front face shroud housing 24, thereby forming an axially extending gap 98 therebetween. Referring to FIGS. 4 and 5, the strip 92 includes a sealing flange 99 and an anchoring flange 101 substantially the same as flanges 80 and 78, respectively, of the sealing strip 76. Widened slots 84 permit the anchoring flange 101 to be secured to the radially extending portion 97 of the wall portion 96 by bolts 102. Of course, it will be understood that other means for attaching the anchoring flange 101 to the wall 97, such as spot welds, can also be used in the scope of the present invention. Moreover, like the sealing strip 76, the sealing strip 92 is subjected to a pressure differential between chamber 100 and flow channel 72 which urges the sealing flange against the sliding wall 94 of the nozzle assembly 28.

Thus, it can be seen that the present invention provides a sealing strip which can conform with the shape of an element and be used to close a gap between variously configured elements so as to seal against leakage between the elements. Moreover, the strip permits relative displacement between the parts without exerting excessive friction between the parts. In addition, the strip utilizes pressure differentials existing between portions of a turbine engine in order to maintain a tight seal between the parts without exerting undue friction or pressure against the parts. In addition, the strip can be constructed to react to the high temperature environment in which the parts are disposed to further increase the sealing ability of the seal. Moreover, the seal is adapted to be used in a turbine engine where certain portions, such as the turbine nozzle, have a variably geometry. Thus, leakage gaps which heretofore have been accepted, or which required extensive maintenance or repair of the sealing elements, can be sealed in an economical and simple manner. Thus, even when the cooling requirements of the variable geometry nozzle vary in accordance with the desired operational characteristics of the turbine engine, the sealing strips of the present invention are readily applicable to prevent leakage and improve efficiency in flow paths within the turbine engine. Moreover, the seals according to the present invention have a long useful life without substantial deterioration of their sealing ability.

Having thus described my invention, many modifications thereto will become apparent to those skilled in the art to which it pertains without departing from the scope and spirit of the present invention as defined in the appended claims.

What is claimed is:

1. A seal for use in a high temperature turbine environment for blocking leakage through a gap between a housing wall and a turbine vane, wherein said turbine vane is relatively displaceable with respect to said housing wall transversely with respect to said gap, said seal comprising, a strip of resilient sheet metal, said strip having a first lengthwise flange and second lengthwise flange angled with respect to said first flange, first means for securing said first flange to said housing wall, said first flange having a plurality of spaced slots, each slot extending from a free edge of said first flange and to the intersection between said first and second flanges so that said second flange generally abuts against and conforms to the surface shape of the vane regardless of the position of said vane with respect to said housing wall.

2. The invention as defined in claim 1 and comprising heat sensitive means for deflecting said second flange toward the vane.

3. The invention as defined in claim 2 wherein said second flange comprises a bimetallic, heat sensitive sheet metal.

4. The invention as defined in claim 2 wherein said heat sensitive means comprises means for deflecting said second flange toward said vane in response to a decrease in temperature.

5. The invention as defined in claim 2 wherein said heat sensitive means comprises means for deflecting said second flange toward said vane in response to an increase in temperature.

6. The invention as defined in claim 1 wherein said housing wall includes first apertures adapted to receive a fastener therein, and wherein each said flange section includes a second aperture to receive said fastener therethrough, each of said first apertures being positioned to register with one of said second apertures.

7. The invention as defined in claim 1 and comprising means for delivering pressurized fluid to one side of said strip for forming a pressure differential across said second flange.

8. The invention as defined in claim 1 wherein said turbine vane extends through an opening in said turbine housing wall and further comprising means for displacing said turbine vane to adjust the axial position of said turbine vane with respect to said housing wall.

9. The invention as defined in claim 8 and further comprising means for delivering a coolant fluid to said vane.

10. A seal for blocking leakage through a gap between a first part and a second part, in a high temperature environment, wherein said second part is relatively displaceable with respect to said first part temperature environment, wherein said second part is relatively displaceable with respect to said first part transversely to said gap, wherein said first part comprises a turbine housing wall and wherein said second part is a turbine vane, wherein said turbine vane extends through an opening in said turbine housing wall and further comprising means for displacing said turbine vane to adjust the axial position of said turbine vane with respect to said housing wall, and further comprising means for delivering a coolant fluid to said vane, wherein said means for delivering a coolant fluid further comprises means for defining a fluid passageway having an inlet orifice, and means for adjusting the size of said orifice.

11. The invention as defined in claim 10 wherein said means for adjusting the size of said orifice comprises means responsive to said means for displacing said turbine vanes for adjusting the orifice size in correspondence with the axial position of said vane with respect to said housing wall.

12. The invention as defined in claim 11 wherein said turbine housing wall is a sidewall of a turbine nozzle, and wherein said means for displacing said turbine vane comprises means for adjusting the length of said vane extending into said nozzle, and wherein said responsive means enlarges the size of said orifice as the length of said vane extending into said nozzle increases, and reduces the size of said orifice as the length of said vane extending into said nozzle is reduced.

13. A seal for blocking leakage through a gap between a first part and a second part, in a high transversely to said gap, said seal comprising:

a strip of sheet metal, said strip having a first lengthwise flange and second lengthwise flange angled with respect to said first flange, first means for securing said first flange to one of said first and second parts, so that said second flange generally conforms to the surface shape of the other of said first and second parts, and second means for resiliently urging said second flange toward the other of said first and second parts across said gap, wherein said first part comprises a turbine housing wall and wherein said second part is a turbine vane, wherein said turbine vane extends through an opening in said turbine housing wall and further comprising means for displacing said turbine vane to adjust the axial position of said turbine vane with respect to said housing wall, and further comprising means for delivering a coolant fluid to said vane, wherein said means for delivering a coolant fluid further comprises means for defining a fluid passageway having an inlet orifice, and means for adjusting the size of said orifice.

* * * * *